US005117857A

United States Patent [19]

Smith

[11] Patent Number: 5,117,857

[45] Date of Patent: Jun. 2, 1992

[54] TRANSFER AND RINSE UNIT

[75] Inventor: Ray S. Smith, Marshall, Mo.

[73] Assignee: Monsanto Company, St. Louis, Mo.

[21] Appl. No.: 365,068

[22] Filed: Jun. 12, 1989

[51] Int. Cl.[5] ..... B08B 3/02; B08B 9/093; B05C 7/02

[52] U.S. Cl. ..... 137/240; 134/166 R; 134/200; 222/148

[58] Field of Search ..... 137/238, 240, 587, 588; 134/166 C, 167 C, 168 C, 169 C, 166 R, 171, 182, 200; 141/85, 92; 222/151

[56] References Cited

U.S. PATENT DOCUMENTS

| | | | |
|---|---|---|---|
| 2,896,643 | 7/1959 | Ottoson | 134/99 |
| 2,933,097 | 4/1960 | Richheimer | 134/166 R |
| 3,348,734 | 10/1967 | Rice et al. | 222/148 |
| 3,407,824 | 10/1968 | Ray | 134/56 |
| 3,916,924 | 11/1975 | McGowan | 134/95 |
| 3,963,036 | 6/1976 | Irelan, Jr. | 134/102 |
| 3,993,221 | 11/1976 | Boynton | 222/87 |
| 4,015,613 | 4/1977 | Papworth | 134/102 |
| 4,039,351 | 8/1977 | Butler | 134/102 |
| 4,088,245 | 5/1978 | Brown | 222/41 |
| 4,092,993 | 6/1978 | Stevenson | 137/238 |
| 4,106,155 | 8/1978 | Fosslien | 15/321 |
| 4,108,336 | 8/1978 | Anderson | 222/148 |
| 4,119,114 | 10/1978 | Bolton et al. | 137/318 |
| 4,142,545 | 3/1979 | Billigmeier | 137/240 |
| 4,144,901 | 3/1979 | Stevenson | 222/148 |
| 4,162,745 | 7/1979 | Anderson | 222/148 |
| 4,171,710 | 10/1979 | Boynton et al. | 137/238 |
| 4,285,445 | 8/1981 | Vander Molen et al. | 222/148 |
| 4,344,469 | 8/1982 | Brown | 137/240 |
| 4,386,637 | 6/1983 | Buchanan et al. | 222/148 |
| 4,480,658 | 11/1984 | Blakeslee et al. | 137/240 |
| 4,606,476 | 8/1986 | Pocock | 222/148 |
| 4,673,006 | 6/1987 | Speck | 141/91 |
| 4,702,267 | 10/1987 | Ashraff | 134/166 |

OTHER PUBLICATIONS

The Model II Chemprobe Operator's Manual (undated publication).

CHEM-EASE Transfer Probe Gun (undated publication).

*Primary Examiner*—George L. Walton

*Attorney, Agent, or Firm*—Senniger, Powers, Leavitt & Roedel

[57] ABSTRACT

A transfer and rinse unit of the present invention is used for transferring liquid from a container to a liquid distribution system, such as spraying apparatus, and for rinsing the container. The unit includes a suction conduit and a rinse conduit positioned alongside one another. The conduits have upper and lower ends and the lower ends of the conduits are adapted to be inserted inside the container. The suction conduit has an inlet adjacent its lower end, and an outlet communicating with a pump whereby liquid may be pumped from the container via the suction tube to the liquid delivery system. The rinse conduit has an inlet adjacent its upper end for connection to a supply of pressurized rinse liquid, and an outlet for flow of rinse liquid into the container. An inlet valve is provided for controlling the flow of rinse liquid into the rinse conduit.

23 Claims, 2 Drawing Sheets

TRANSFER AND RINSE UNIT

BACKGROUND OF THE INVENTION

This invention relates generally to a mechanical system for transferring liquids such as herbicides from a container to spray equipment or the like and, more particularly, to such a transfer system which is also suited for rinsing the container.

Liquid herbicides are sold in bulk quantities for agricultural use, often in plastic containers or jugs of two and one half gallons or more. To use the herbicide, the liquid must be transferred in some manner to suitable equipment for distributing the herbicide, such as spraying apparatus. This transfer can pose problems in that the user may be exposed to the herbicide, which may pose a safety problem. Moreover, the herbicide is sometimes viscous, making transfer of the material and complete emptying of the container difficult. Rinsing of the container after it has been emptied to comply with various regulations is also a time-consuming task. There is a need, therefore, for an efficient and economical transfer and rinse system to alleviate the aforementioned problems.

SUMMARY OF THE INVENTION

Among the several objects of this invention may be noted the provision of an improved transfer and rinse system for transferring liquid such as a herbicide from a container to spraying apparatus or the like; the provision of such a system which is adapted for quickly transferring even viscous materials from the container; the provision of such a system which eliminates the need for open pouring from the container, thereby eliminating exposure to the liquid; the provision of such a system which reduces lifting and handling of the container; the provision of such a system which "power rinses" containers quickly to comply with rinse and disposal regulations; the provision of such a system which minimizes waste by flushing the container so that its entire contents are transferred in the rinse liquid to the spraying apparatus or the like; and the provision of such a system which is economical and easy to use.

Briefly, a transfer and rinse unit of the present invention is used for transferring liquid from a container to a liquid distribution system, such as spraying apparatus, and for rinsing the container. The unit comprises a suction conduit and a rinse conduit positioned alongside one another. The conduits have upper and lower ends and the lower ends of the conduits are adapted to be inserted into the container. The suction conduit has an inlet adjacent its lower end, and an outlet adapted for communicating with pump means whereby liquid may be pumped from the container via the suction conduit for delivery to the liquid distribution system. The rinse conduit has an inlet adjacent its upper end adapted for connection to a supply of rinse liquid, and outlet means for flow of rinse liquid into the container. Inlet valve means is provided for controlling the flow of rinse liquid into the rinse conduit.

A transfer and rinse system of this invention includes not only the aforementioned transfer and rinse unit but also a container of liquid (e.g., herbicide), and pump means in communication with the outlet of the suction conduit for pumping liquid from the container via the suction conduit for delivery to the liquid distribution system.

Other objects and features of this invention will be in part apparent and in part pointed out hereinafter.

BRIEF DESCRIPTION OF THE DRAWINGS

Corresponding parts are designated by corresponding reference numerals throughout the several views of the drawings.

DESCRIPTION OF PREFERRED EMBODIMENTS

Figure 1:
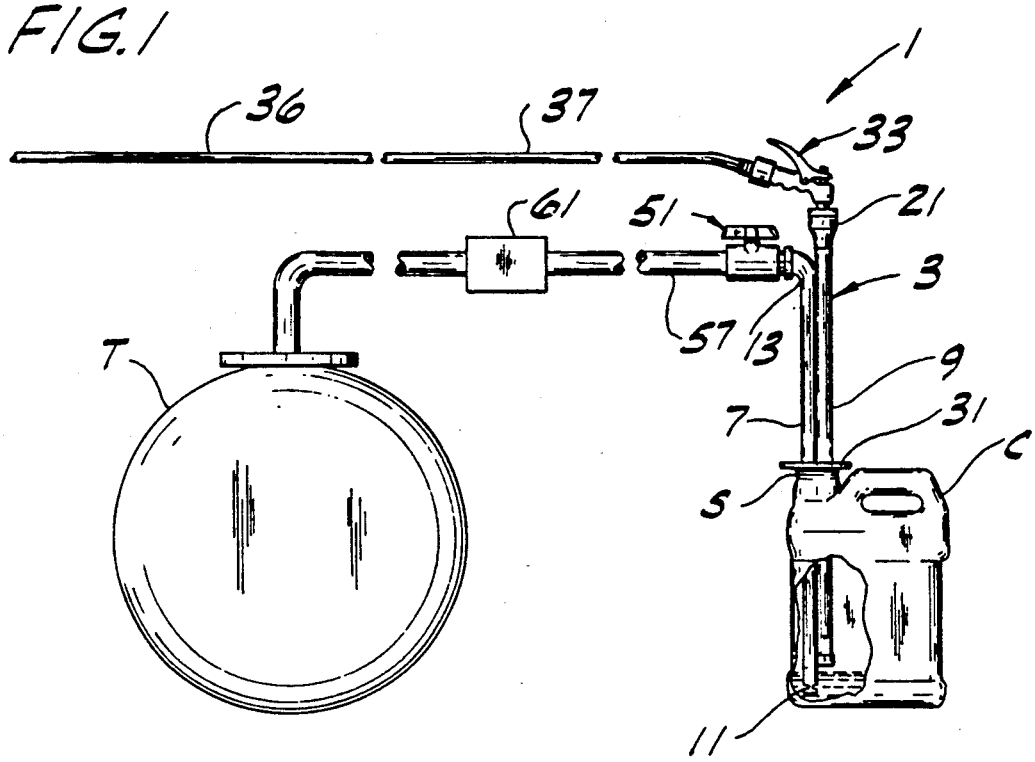
FIG. 1 is an elevational view of a transfer and rinse system of the present invention.

Referring now to the drawings, and first more particularly to FIG. 1, a transfer and rinse system of the present invention is indicated in its entirety by the reference numeral 1. As illustrated, the system comprises a transfer and rinse unit, generally designated 3, for transferring liquid such as a herbicide from a container C (e.g., a 2½-gal. plastic jug) for delivery to a liquid distribution system, such as spraying apparatus, including a spray tank designated T.

The transfer and rinse unit comprises a suction conduit, designated 7, and a rinse conduit, designated 9, positioned in non-concentric fashion alongside one another in fixed position relative to one another. The conduits 7, 9 are preferably two separate cylindric tubes permanently bonded (e.g., welded) to one another, but it will be understood that other configurations may also be suitable. As shown, the lower ends of the tubes 7, 9 are adapted to be inserted through a pour spout S of the container and into the container to a position in which the lower end of the suction tube 7 is adjacent the bottom of the container C. The suction tube 7 has an inlet 11 adjacent its lower end constituted by the open lower end of the tube, and an outlet 13 adjacent its upper end constituted by the open upper end of the tube. The lower end of the suction tube has openings indicated at 17 to permit flow of liquid up through the suction tube even though the tube may be resting on the bottom of the container. The rinse tube 9 has an inlet 21 adjacent its upper end constituted by the open upper end of the tube and outlet means comprising a series of holes 23 in the tube spaced at intervals along and around the tube adjacent its lower end, which is capped as indicated at 25. The cap 25 has an opening (not shown) in its bottom. Thus pressurized rinse water entering the rinse tube exits these holes 23 and impacts against the side and bottom walls of the container C to flush the container and rinse it. The holes should be sufficient in number and so arranged as to provide for complete rinsing of the container.

A splash guard 31 in the form of a flat plastic disc is slidable along the suction and rinse tubes 7, 9 for sealing against the top of the pour spout S of the container to prevent liquid from splashing out of the container during the transfer/rinsing process. Other types of splash guards may be used without departing from the scope of this invention.

Indicated generally at 33 is valve means at the inlet (upper) end of the rinse tube 9. Inlet valve means 33 comprises a valve body 35 having a passage (not shown) therethrough with an inlet connected to a pressurized source 36 of rinse water via a rinse line 37, and an outlet connected to the inlet 21 of the rinse tube 9 via a suitable fitting 39. A valve member 41 is movable in the passage between open and closed positions. The valve member is actuated by a hand-operable valve actuator 43 in the form of a trigger mechanism, although it will be understood that other actuators may also be used. Squeezing the trigger actuator 43 moves the valve member 41 to an open position to permit flow of rinse liquid (e.g., water) into the rinse tube 9. The valve member 41 is spring biased toward a closed position so that release of the actuator 43 causes the valve member to move to its closed position to prevent further flow of rinse liquid into the rinse tube.

Indicated generally at 51 is valve means at the outlet (upper) end of the suction tube 7. Outlet valve means 51 comprises a valve body 53 having a passage (not shown) therethrough with an inlet connected to the outlet 13 of the suction tube 7 via a connector 55, and an outlet connected to a discharge line 57. A valve member (not shown) is movable in the passage between open and closed positions by turning a valve wheel 59 (other valve actuators may also be used).

A self-priming pump 61 (pump means) is provided in the discharge line 57 downstream from the suction tube outlet valve 51 for pumping liquid from the container through the suction tube 7 for delivery to the spray tank T.

To use the transfer and rinse system of FIG. 1, the discharge line 57 is connected to the suction tube outlet valve 51 and rinse line 37 (e.g., garden hose) is connected to the rinse tube inlet valve 33. The lower ends of the suction and rinse tubes 7, 9 are then inserted into the container to a position adjacent the bottom of the container and the splash guard 31 moved to a position in which it seals against the pour spout to prevent splashing of liquid out of the container. With the suction tube outlet valve 51 open, the pump 61 is activated to pump liquid from the container for delivery to the spray tank T. After the container is empty, the rinse tube inlet valve 33 is opened for a relatively short period of time (e.g., five seconds) by squeezing the trigger actuator 33 to allow pressurized rinse liquid to flow from the rinse source 36 through the rinse tube 9 and to jet out of the exit openings 23 and into the container to rinse it. As this happens, the pump 61 continues to operate to pump the rinse out of the container via the suction tube 7 and delivery line 57 until the container is once again empty. This process is repeated (e.g., three times) until the container is completely rinsed, clean and ready for disposal.

In this embodiment of the invention, the source 36 of pressurized rinse liquid and the pump 61 communicate with one another only by means of a single flow path which, as explained above and illustrated in the drawings, extends from the source 36 to the rinse tube 9 via the rinse line 37, from the rinse tube into the container via the exit openings 23, from the container into the suction tube 7 via the suction tube inlet openings 17, and from the suction tube outlet 13 to the pump via the delivery line 57.

Figure 3:
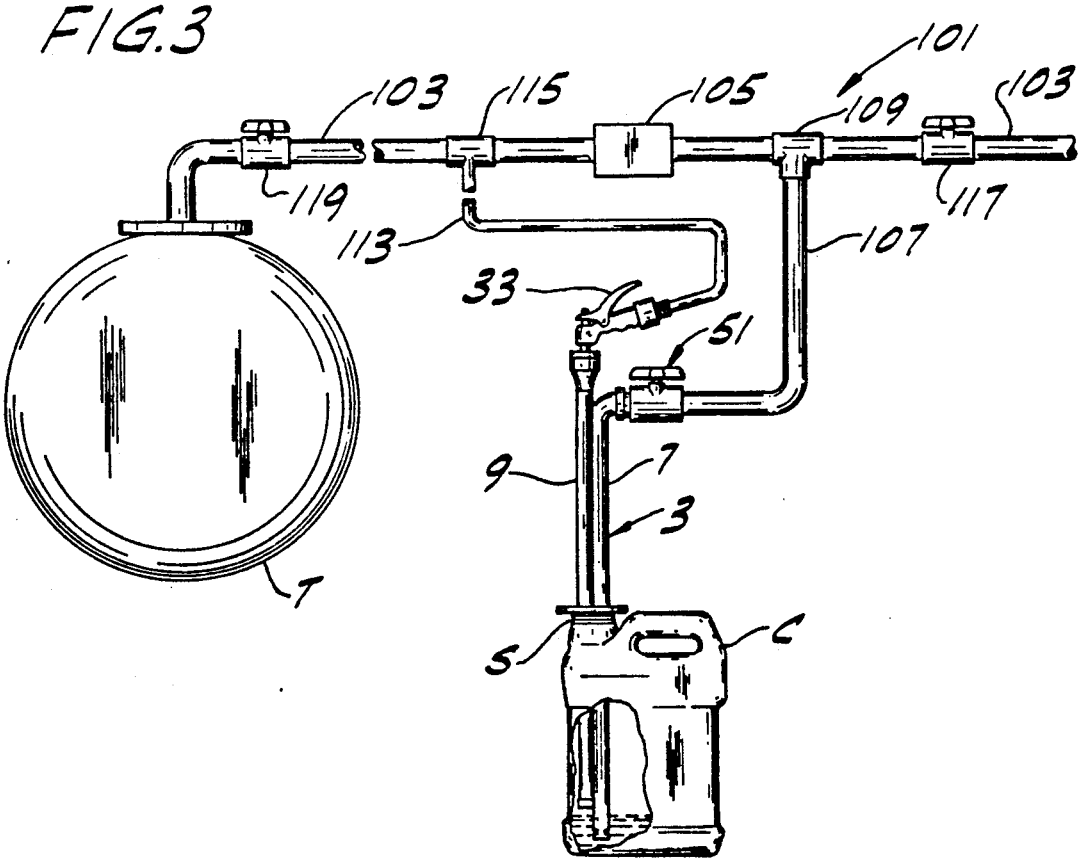
FIG. 3 is a view similar to FIG. 1 illustrating another embodiment of the system.
Figure 2:
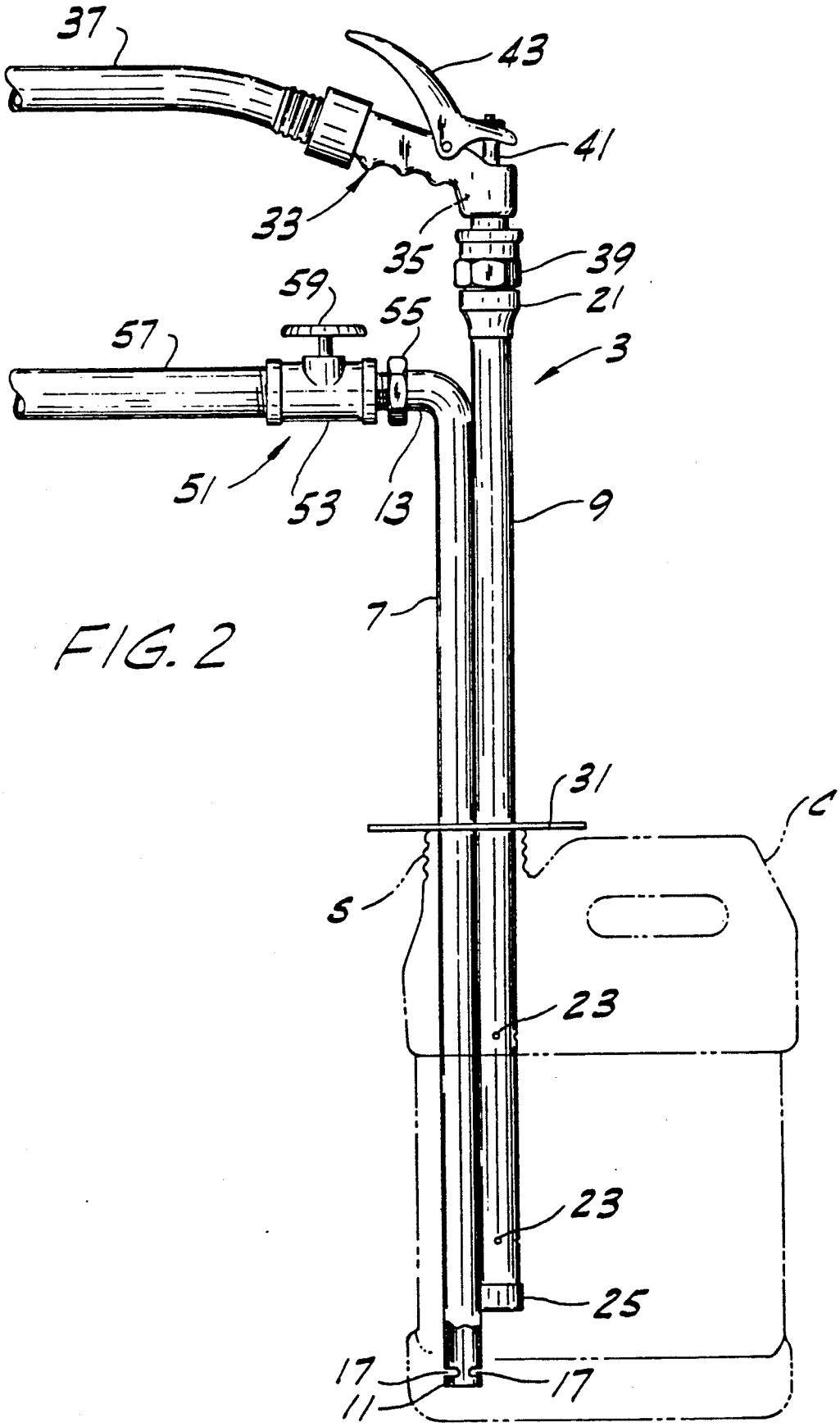
FIG. 2 is an elevational view of a transfer and rinse unit of the system.

FIG. 3 shows another embodiment of a transfer and rinse system of the present invention. The FIG. 3 system, generally designated 101, is similar to the system shown in FIGS. 1 and 2 and corresponding parts are thus designated by the same reference numerals. In this system 101 liquid is pumped from a suitable source (such as a nurse tank, not shown) into a sprayer tank T, for example, through a main supply line 103 having a pump 105 therein. The suction tube outlet valve 51 is connected to the main supply line 103 at a point upstream of the pump by means of a suction line 107 and tee fitting 109. The rinse tube inlet valve 33 is connected to the main supply line 103 at a point downstream of the pump 105 by means of a rinse line 113 and a tee fitting 115, so that a portion of the liquid discharged by the pump serves as rinse liquid for the container. A suitable hand-operable valve 117 is provided in the main supply line upstream 103 from the tee fitting 109 and a similar valve 119 is provided downstream from the tee fitting 115.

Use of the system 101 of FIG. 3 is identical to use of the system 1 shown in FIG. 1 except that, at the start of the process, the suction tube outlet valve 51 should not be opened until the pump 105 is activated. Valves 117, 119 may have to be partially closed in order to obtain the necessary suction and/or pressure to operate the system.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A transfer and rinse unit for transferring liquid from a container to a liquid distribution system, such as spraying apparatus, and for rinsing the container, said unit comprising:

a suction conduit and a rinse conduit positioned alongside one another, said conduits having upper and lower ends, the lower ends of the conduits being adapted to be inserted inside said container, said suction and rinse conduits comprising two separate tubes permanently connected to one another alongside one another in non-concentric fashion, the suction tube having an inlet adjacent its lower end, and an outlet adjacent its upper end, a first connector at the outlet end of the suction tube for removably connecting the suction tube to a line for delivery of liquid from the container to a liquid distribution system, said line having a pump therein separate from the rinse and transfer unit and downstream from the rinse and transfer unit after the suction tube has been connected to said delivery line via said first connector, the rinse tube having an inlet adjacent its upper end and outlet means for flow of rinse liquid into the container, said outlet means of the rinse tube comprising a series of holes in the tube spaced at intervals along the tube adjacent its lower end, said rinse liquid being adapted to exit said holes for impact against a side wall of the container, a second connector at the inlet end of the rinse tube for removably connecting the rinse tube to a rinse line communicating with a source of pressurized rinse liquid for supply of rinse liquid to the rinse tube, inlet valve means for controlling the flow of rinse liquid into the rinse tube, the arrangement being such that when the upper ends of the rinse and suction tubes are connected to respective rinse and delivery lines via said connectors, and the lower ends of the rinse and suction tubes are inserted into said container, said pump is operable to pump liquid from the container, said pump and said source of pressurized rinse liquid communicating with one another only by means of a single flow path extending from said source to said rinse tube via said rinse line, from said rinse tube into the container via said outlet means, from the container into the suction tube via said suction tube inlet, and from the outlet of the suction tube to said pump via said delivery line.

2. A transfer and rinse unit as set forth in claim 1 wherein said inlet valve means is hand operable.

3. A transfer and rinse unit as set forth in claim 2 wherein said inlet valve means comprises a valve body connected to the rinse tube at the inlet of the rinse tube, a valve member movable in the valve body between open and closed positions, and a hand-operable valve actuator for moving said valve member between its open and closed positions.

4. A transfer and rinse unit as set forth in claim 1 wherein said suction and rinse tube are permanently bonded together in fixed position relative to one another.

5. A transfer and rinse unit as set forth in claim 1 further comprising a splash guard on said rinse and suction tube above said outlet means of the rinse tube for preventing liquid from splashing out of said container.

6. A transfer and rinse unit as set forth in claim 5 wherein said splash guard is slidable along said rinse and suction tube.

7. A transfer and rinse unit for transferring liquid from a container to a liquid distribution system, such as spraying apparatus, and for rinsing the container, said unit comprising a switch conduit and a rinse conduit positioned alongside one another, said conduits having upper and lower ends, the lower ends of the conduits being adapted to be inserted inside said container, said suction and rinse conduits comprising two separate tubes secured in non-concentric fashion alongside one another, the suction tube having an inlet adjacent its lower end, and an outlet adapted for communicating with pump means whereby liquid may be pumped from the container via said suction conduit for delivery to said liquid distribution system, the rinse tube having an inlet adjacent its upper end adapted for connection to a supply of pressurized rinse liquid, and outlet means for flow of rinse liquid into the container, said outlet means of the rinse tube comprising a series of holes in the tube spaced at intervals along the tube against its lower end, said rinse liquid being adapted to exit said holes for impact against a side wall of the container, inlet valve means for controlling the flow of rinse liquid into the rinse tube, and outlet valve means at the outlet of the suction tube for controlling the flow of liquid through the suction tube in downstream direction.

8. A transfer and rinse unit as set forth in claim 7 wherein said outlet valve means is hand operable.

9. A transfer and rinse unit as set forth in claim 8 wherein said outlet valve means comprises a valve body connected to the suction tube at the outlet of the suction tube, a valve member movable in the valve body between open and closed positions, and a hand-operable valve actuator for moving said valve member between its open and closed positions.

10. A transfer and rinse system for transferring liquid from a container to a liquid distribution system, such as spraying apparatus, and for rinsing the container, said unit comprising:

a container of liquid, a suction conduit and a rinse conduit positioned alongside one another, said conduits having upper and lower ends, the lower ends of the conduits being adapted to be inserted inside the container, said suction and rinse conduits comprising two separate tubes permanently connected to one another alongside one another, the suction tube having an inlet adjacent its lower end, and an outlet generally adjacent its upper end, a first connector at the outlet end of the suction tube for removably connecting the suction tube to a line for delivery of liquid from the container to a liquid distribution system, a pump communicating with the outlet of the suction tube for pumping liquid from the container via said suction tube for delivery to said liquid distribution system, the rinse tube having an inlet adjacent its upper end and outlet means for flow of rinse liquid into the container, said outlet means of the rinse tube comprising a series of holes in the tube spaced at intervals along the tube adjacent its lower end, said rinse liquid being adapted to exit said holes for impact against a side wall of the container, a second connector at the inlet end of the rinse tube for removably connecting the rinse tube to a rinse line communicating with a source of pressurized rinse liquid for supply of rinse liquid to the rinse tube, and inlet valve means for controlling the flow or rinse liquid into the rinse tube, the arrangement being such that when the upper end of the rinse and suction tubes are connected to respective rinse and delivery lines via said connectors, and the lower ends of the rinse and suction tubes are inserted into said container, said pump is operable to pump liquid from the container, said pump and said source of pressurized rinse liquid communicating with one another only by means of a single flow path extending from said source to said rinse tube via said rinse line, from said rinse tube into the container via said outlet means, from the container into the suction tube via said suction tube inlet, and from the outlet of the suction tube to said pump via said delivery line.

11. A transfer and rinse system as set forth in claim 10 wherein said inlet valve means is hand operable.

12. A transfer and rinse system as set forth in claim 11 wherein said inlet valve means comprises a valve body connected to the rinse tube at the inlet of the rinse conduit, a valve member movable in the valve body between open and closed positions, and a hand-operable valve actuator for moving said valve member between its open and closed positions.

13. A transfer and rinse system as set forth in claim 10 wherein said outlet means of the rinse tube comprises a series of holes in the tube spaced at intervals along the tube adjacent its lower end, said rinse liquid being adapted to exit said holes for impact against a side wall of the container.

14. A transfer and rinse system as set forth in claim 10 wherein said suction and rinse tube are two separate tubes permanently bonded together in fixed position relative to one another.

15. A transfer and rinse system as set forth in claim 10 further comprising a splash guard on said rinse and suction tube above said outlet means of the rinse tube for preventing liquid from splashing out of said container.

16. A transfer and rinse system as set forth in claim 15 wherein said splash guard is slidable along said rinse and suction tube.

17. A transfer and rinse system for transferring liquid from a container to a liquid distribution system, such as spraying apparatus, and for rinsing the container, said system comprising a container of liquid, a suction conduit and a rinse conduit positioned alongside one another, said conduits having upper and lower ends, the lower ends of the conduits being adapted to be inserted into the inside the container, said suction and rinse conduits comprising two separate tubes secured in non-concentric fashion alongside one another, the suction tube having an inlet adjacent its lower end, and an outlet generally adjacent its upper end, pump means in communication with the outlet of the suction tube for pumping liquid from the container via said suction conduit for delivery to said liquid distribution system, the rinse tube having an inlet adjacent its upper end adapted for connection to a supply of pressurized rinse liquid, and outlet means for flow of rinse liquid into the container, said outlet means of the rinse tube comprising a series of holes in the tube spaced at intervals along the tube adjacent its lower end, said rinse liquid being adapted to exit said holes for impact against a side wall of the container, inlet valve means for controlling the flow of rinse liquid into the rinse tube, and outlet valve means at the outlet of the suction conduit and upstream from said pump for controlling the flow of liquid through the suction tube in downstream direction.

18. A transfer and rinse system as set forth in claim 17 wherein said outlet valve means is hand operable.

19. A transfer and rinse system as set forth in claim 18 wherein said outlet valve means comprises a valve body connected to the suction tube at the outlet of the suction tube, a valve member movable in the valve body between open and closed positions, and a hand-operable valve actuator for moving said valve member between its open and closed positions.

20. A transfer and rinse system for transferring liquid from a container to a liquid distribution system, such as spraying apparatus, and for rinsing the container, said system comprising a container of liquid, a suction conduit and a rinse conduit positioned alongside one another, said conduits having upper and lower ends, the lower ends of the conduits being adapted to be inserted into the inside the container, said suction and rinse conduits comprising two separate tubes secured in non-concentric fashion alongside one another, the suction tube having an inlet adjacent its lower end, and an outlet generally adjacent its upper end, pump means in communication with the outlet of the suction tube for pumping liquid from the container via said suction tube for delivery to said liquid distribution system, the rinse tube having an inlet adjacent its upper end adapted for connection to a supply of pressurized rinse liquid, and outlet means for flow of rinse liquid into the container, inlet valve means for controlling the flow of rinse liquid into the rinse conduit, and a main supply line for flow of liquid from a source to said liquid distribution system, said pump being positioned in said main supply line, a suction line connecting the outlet of the suction tube with said main supply line at a point upstream from said pump and a rinse line connecting the inlet of the rinse tube with said main supply line at a point downstream from said pump whereby a portion of liquid discharged from said pump serves as said rinse liquid when said inlet valve means it open and said liquid is being discharged to said liquid distribution system.

21. A transfer and rinse system for transferring liquid from a container to a liquid distribution system, such as spraying apparatus, and for rinsing the container, said unit comprising:

a container of liquid, a suction conduit and a rinse conduit positioned alongside one another, said conduits having upper and lower ends, the lower ends of the conduits being adapted to be inserted inside the container, said suction and rinse conduits comprising two separate tubes permanently connected to one another alongside one another in non-concentric fashion, the suction tube having an inlet adjacent its lower end, and an outlet generally adjacent its upper end, a first connector at the outlet end of the suction tube for removably connecting the suction tube to a line for delivery of liquid from the container to a liquid distribution system, a pump communicating with the outlet of the suction tube for pumping liquid from the container via said suction tube for delivery to said liquid distribution system, the rinse tube having an inlet adjacent its upper end and outlet means for flow of rinse liquid into the container, a second connector at the inlet end of the rinse tube for removably connecting the rinse tube to a rinse line communicating with a source of pressurized rinse liquid for supply of rinse liquid to the rinse tube, and inlet valve means for controlling the flow of rinse liquid into the rinse tube, the arrangement being such that when the upper ends of the rinse and suction tubes are connected to respective rinse and delivery lines via said connectors, and the lower ends of the rinse and suction tubes are inserted into said container, said pump is operable to pump liquid from the container, said pump and said source of pressurized rinse liquid communicating with one another only by means of a single flow path extending from said source to said rinse tube via said rinse line, from said rinse tube into the container via said outlet means, from the container into the suction tube via said suction tube inlet, and from the outlet of the suction tube to said pump via said delivery line, said pump comprising a self-priming pump in a discharge line downstream from the outlet of the suction conduit, said pump being operable for pumping liquid from the container independent of said supply of rinse liquid.

22. A transfer and rinse unit for transferring liquid from a container to a liquid distribution system, such as spraying apparatus, and for rinsing the container, said unit comprising:

a suction conduit and a rinse conduit positioned alongside one another, said conduits having upper and lower ends, the lower ends of the conduits being adapted to be inserted inside said container, said suction and rinse conduits comprising two separate tubes permanently connected to one another alongside one another in non-concentric fashion, the suction tube having an inlet adjacent its lower end, and an outlet adjacent its upper end adapted for communication with pump means whereby liquid may be pumped from the container via said suction conduit for delivery to said liquid distribution system, the rinse tube having an inlet adjacent its upper end adapted for connection to a supply of pressurized rinse liquid, and outlet means for flow of rinse liquid into the container comprising a series of holes in the tube spaced at intervals along the tube, inlet valve means for controlling the flow of rinse liquid into the rinse tube conduit, and means for capping the lower end of the rinse tube so that rinse liquid entering the tube is forced out through said holes in the tube for impact against one or more side walls of the container to rinse them.

23. A transfer and rinse unit for transferring liquid from a container to a liquid distribution system, such as spraying apparatus, and for rinsing the container, said unit comprising:

a suction conduit and a rinse conduit positioned alongside one another, said conduits having upper and lower ends, the lower ends of the conduits being adapted to be inserted inside said container, said suction and rinse conduits comprising two separate tubes permanently connected to one another alongside one another in non-concentric fashion, the suction tube having an inlet adjacent its lower end, and an outlet adjacent its upper end, a first connector at the outlet end of the suction tube for removably connecting the suction tube to a line for delivery of liquid from the container to a liquid distribution system, said line having a pump therein separate from the rinse and transfer unit and downstream from the rinse and transfer unit after the suction tube has been connected to said delivery line via said first connector, the rinse tube having an inlet adjacent its upper end and outlet means for flow of rinse liquid into the container, said outlet means of the rinse tube comprising a series of holes in the tube spaced at intervals along the tube adjacent its lower end, said rinse liquid being adapted to exit said holes for impact against a side wall of the container, a second connector at the inlet end of the rinse tube for removably connecting the rinse tube to a rinse line communicating with a source of pressurized rinse liquid for supply of rinse liquid to the rinse tube, inlet valve means for controlling the flow of rinse liquid into the rinse tube, the arrangement being such that when the upper ends of the rinse and suction tubes are connected to respective rinse and delivery lines via said connectors, and the lower ends of the rinse and suction tubes are inserted into said container, said pump is operable to pump liquid from the container, said pump and said source of pressurized rinse liquid communicating with one another only by means of a single flow path extending from said source to said rinse tube via said rinse line, from said rinse tube into the container via said outlet means, from the container into the suction tube via said suction tube inlet, and from the outlet of the suction tube to said pump via said delivery line, said delivery line and said rinse line being unconnected except by said single flow path through the container so that liquid pumped from the container into the delivery line cannot flow from the delivery line back to the rinse line.

* * * * *

UNITED STATES PATENT AND TRADEMARK OFFICE

CERTIFICATE OF CORRECTION

PATENT NO. : 5,117,857

DATED : June 2, 1992

INVENTOR(S) : Ray S. Smith

It is certified that error appears in the above—identified patent and that said Letters Patent is hereby corrected as shown below:

Column 5, claim 4, line 21, "rinse tube" should read ---rinse tubes---.

Column 5. claim 7, line 53, "tube against its" should read ---tube adjacent its --.

Column 5, claim 5, line 26, "suction tube above" should read ---suction tubes above Column 5, claim 6, line 31, "suction tube" should read ---suction tubes---.

Column 6, claim 10, line 40, "upper end" should read ---upper ends---.

Column 6, claim 12, lines 58-59, "rinse conduit" should read ---rinse tube---.

Column 7, claim 14, line 2, "rinse tube" should read ---rinse tubes---.

Column 7, claim 15, line 7, "suction tube" should read ---suction tubes---.

Column 7, claim 16, line 12, "suction tube" should read ---suction tubes---.

Column 9, claim 22, line 23, "suction conduit" should read ---suction tube---.

UNITED STATES PATENT AND TRADEMARK OFFICE

CERTIFICATE OF CORRECTION

PATENT NO. : 5,117,857

DATED : June 2, 1992

INVENTOR(S) : Ray S. Smith

It is certified that error appears in the above-indentified patent and that said Letters Patent is hereby corrected as shown below:

Column 9, claim 22, line 31, "tube conduit, and" should read --tube, and--.

Signed and Sealed this

Thirty-first Day of August, 1993

Bruce Lehman

*Attest:*

BRUCE LEHMAN

*Attesting Officer*

*Commissioner of Patents and Trademarks*